US012221849B2

(12) United States Patent
Gao et al.

(10) Patent No.: US 12,221,849 B2
(45) Date of Patent: Feb. 11, 2025

(54) INTERNAL BLOWOUT-PREVENTION GAS-RETAINING CONNECTOR FOR MINE

(71) Applicant: SICHUAN UNIVERSITY, Sichuan (CN)

(72) Inventors: Mingzhong Gao, Sichuan (CN); Ling Chen, Sichuan (CN); Jianan Li, Sichuan (CN); Cong Li, Sichuan (CN); Zhiqiang He, Sichuan (CN); Le Zhao, Sichuan (CN); Mingqing Yang, Sichuan (CN); Nianhan Wu, Sichuan (CN); Bo Yu, Sichuan (CN)

(73) Assignee: SICHUAN UNIVERSITY, Sichuan (CN)

( * ) Notice: Subject to any disclaimer, the term of this patent is extended or adjusted under 35 U.S.C. 154(b) by 50 days.

(21) Appl. No.: 17/997,275

(22) PCT Filed: Jan. 26, 2021

(86) PCT No.: PCT/CN2021/073845
§ 371 (c)(1),
(2) Date: Oct. 27, 2022

(87) PCT Pub. No.: WO2021/218253
PCT Pub. Date: Nov. 4, 2021

(65) Prior Publication Data

US 2023/0175339 A1 Jun. 8, 2023

(30) Foreign Application Priority Data

Apr. 27, 2020 (CN) ..... 202010345496.1

(51) Int. Cl.
*E21B 34/14* (2006.01)
*E21B 33/06* (2006.01)
*E21B 34/12* (2006.01)

(52) U.S. Cl.
CPC ..... *E21B 33/06* (2013.01); *E21B 34/12* (2013.01); *E21B 34/14* (2013.01)

(58) Field of Classification Search
CPC ..... E21B 34/12; E21B 34/14; E21B 2200/05
See application file for complete search history.

(56) References Cited

U.S. PATENT DOCUMENTS 2,921,601 A * 1/1960 Fisher, Jr. ..... E21B 34/08 251/339
3,845,818 A * 11/1974 Deaton ..... E21B 34/105 166/324

(Continued)

FOREIGN PATENT DOCUMENTS

CN 202596665 U 12/2012
CN 110005362 A 7/2019

(Continued)

*Primary Examiner* — Giovanna Wright
(74) *Attorney, Agent, or Firm* — NKL Law; Allen Xue

(57) ABSTRACT

An internal blowout-prevention gas-retaining connector has a body mounted at the bottom of a drill pipe. The body includes a valve pipe section and a connecting pipe section arranged from top to bottom. The bottom of the valve pipe section is inserted into the top of the connecting pipe section. The blowout-prevention valve seat is provided at a bottom end of the valve pipe section while a blowout-prevention valve bonnet is provided on a bottom surface of the valve pipe section. The edge of the blowout-prevention valve bonnet is rotatably connected to a bottom surface edge of the valve pipe section. A torsion spring is provided on a bottom surface of the blowout-prevention valve bonnet. One end of the torsion spring is connected to the bottom surface of the blowout-prevention valve bonnet while the other end is connected to the inner wall of the connecting pipe section.

6 Claims, 4 Drawing Sheets

(56) References Cited

U.S. PATENT DOCUMENTS

| | | | | |
|---|---|---|---|---|
| 5,095,994 | A * | 3/1992 | Dollison | E21B 34/08 166/323 |
| 6,196,261 | B1 * | 3/2001 | Dennistoun | E21B 34/10 251/63.4 |
| 2017/0067315 | A1 | 3/2017 | Mailand et al. | |
| 2018/0163498 | A1 | 6/2018 | Hendel et al. | |

FOREIGN PATENT DOCUMENTS

| | | | |
|---|---|---|---|
| CN | 111021989 | A | 4/2020 |
| CN | 111485854 | A | 8/2020 |
| CN | 212225173 | U | 12/2020 |

* cited by examiner

INTERNAL BLOWOUT-PREVENTION GAS-RETAINING CONNECTOR FOR MINE

TECHNICAL FIELD

The present invention relates to the field of a coring equipment for coal mine tunnel, and especially to an internal blowout-prevention gas-retaining connector for mine.

BACKGROUND TECHNOLOGY

China is not only a big country in coal production, but also a big country in coal consumption. Coal is an important basic energy and raw material in China. Gas content in coal seam and gas pressure in coal seam are the main indexes for the prediction of coal seams outburst risk area and the inspection of zone effect. Coal seam gas content is usually measured by surface coalbed gas content determination, gas content measurement in geological exploration, underground coal seam drilling coring, etc.

The coring apparatus is usually composed of an inner pipe assembly and an outer pipe assembly. There is a gap between the inner pipe assembly and the outer pipe assembly, which leads to a high risk of gas leakage. At present, a blowout-prevention box located at the top of the drill pipe is often used to prevent the gas leakage, but there was still gas in the drill pipe, resulting in a safety hazard in the coring operation.

When coring operations are carried out in mine coal seams, it is usually necessary to lift and lower the corer inside the drill pipe for many times. During the process of lifting and lowering the corer, the inner hole of the drill pipe communicates with the bottom of the hole and the external environment, which often causes gas leakage. In the prior art, ball valves, cone valves and other forms are mainly used to prevent the leakage, and the inner hole of the valve does not allow large-diameter tools to pass through, and only allows fluid media such as gas to pass through.

CONTENT OF THE INVENTION

The present invention is intended to provide an internal blowout-prevention gas-retaining connector for mine, which has an automatic closing function when being used to perform a coring operation in a mine coal seam, gas leakage is reduced, and a large-caliber tool is allowed to pass through. To achieve the above object, the present invention is realized by using the following technical solutions:

The present invention provides an internal blowout-prevention gas-retaining connector for mine, which comprises a body, and the body is mounted at the bottom of a drill pipe; the body comprises a valve pipe section and a connecting pipe section arranged from top to bottom; the bottom of the valve pipe section is inserted into the top of the connecting pipe section; a blowout-prevention valve seat is provided at a bottom end of the valve pipe section, and a blowout-prevention valve bonnet is provided on a bottom surface of the valve pipe section; an edge of the blowout-prevention valve bonnet is rotatably connected to a bottom surface edge of the valve pipe section; a torsion spring is provided on a bottom surface of the blowout-prevention valve bonnet; one end of the torsion spring is connected to the bottom surface of the blowout-prevention valve bonnet, and the other end of the torsion spring is connected to the inner wall of the connecting pipe section.

Preferably, a male terminal section is provided at the bottom of the valve pipe section, a female terminal section is provided at the top of the connecting pipe section, an outlet section in provided at the bottom of the connecting pipe, and the inner diameter of the female terminal section is greater than the outlet section.

Preferably, the sum of the length of the male terminal section and the diameter of the blowout-prevention valve bonnet≤the length of the female terminal section.

Preferably, the blowout-prevention valve bonnet can be elastically deformed;

when the blowout-prevention valve bonnet is in the open state, the blowout-prevention valve bonnet is curved, and the blowout-prevention valve bonnet is adapted to the inner wall of the female terminal section;

when the blowout-prevention valve bonnet is in the closed state, the blowout prevention valve bonnet is plate-shaped.

Preferably, a cylindrical pin is also comprised, which is arranged on the bottom surface of the blowout-prevention valve bonnet, and penetrates through the blowout-prevention valve bonnet and the torsion spring.

Preferably, the valve pipe section and the connecting pipe section are threadedly connected, and the top of the outer wall of the male terminal section and the top of the inner wall of the female terminal section are provided with mutually adapted threads.

Preferably, the sealing surface of the blowout-prevention valve seat is the first inclined surface whose diameter gradually increases from top to bottom, the sealing surface of the blowout-prevention valve bonnet is the second inclined surface, and the first inclined surface is adapted to the second inclined surface.

The Advantages of the Present Invention

1. The present invention can reduce the leakage of gas.
2. The present invention has the simple structure and good reliability.
3. The present invention allows a large-caliber tool to pass through.

In the figures: 1—roller device, 2—transfer device, 3—coring apparatus, 4—drill pipe, 5—blowout-prevention box, 6—drill pipe driving device, 701—valve pipe section, 702—connecting pipe section, 703—female terminal section, 704—outlet section, 705—male terminal section, 706—blowout-prevention valve seat, 707—blowout-prevention valve bonnet, 709—cylindrical pin, 710—the first inclined surface, 711—the second inclined surface, 8—puller component, 9—injection head, and 10—inner pipe assembly.

EXAMPLES

In order to clarify the object, technical solutions, and advantages of the present invention, combined with the Figures, the present invention was further elucidated in the following.

Figure 1A:
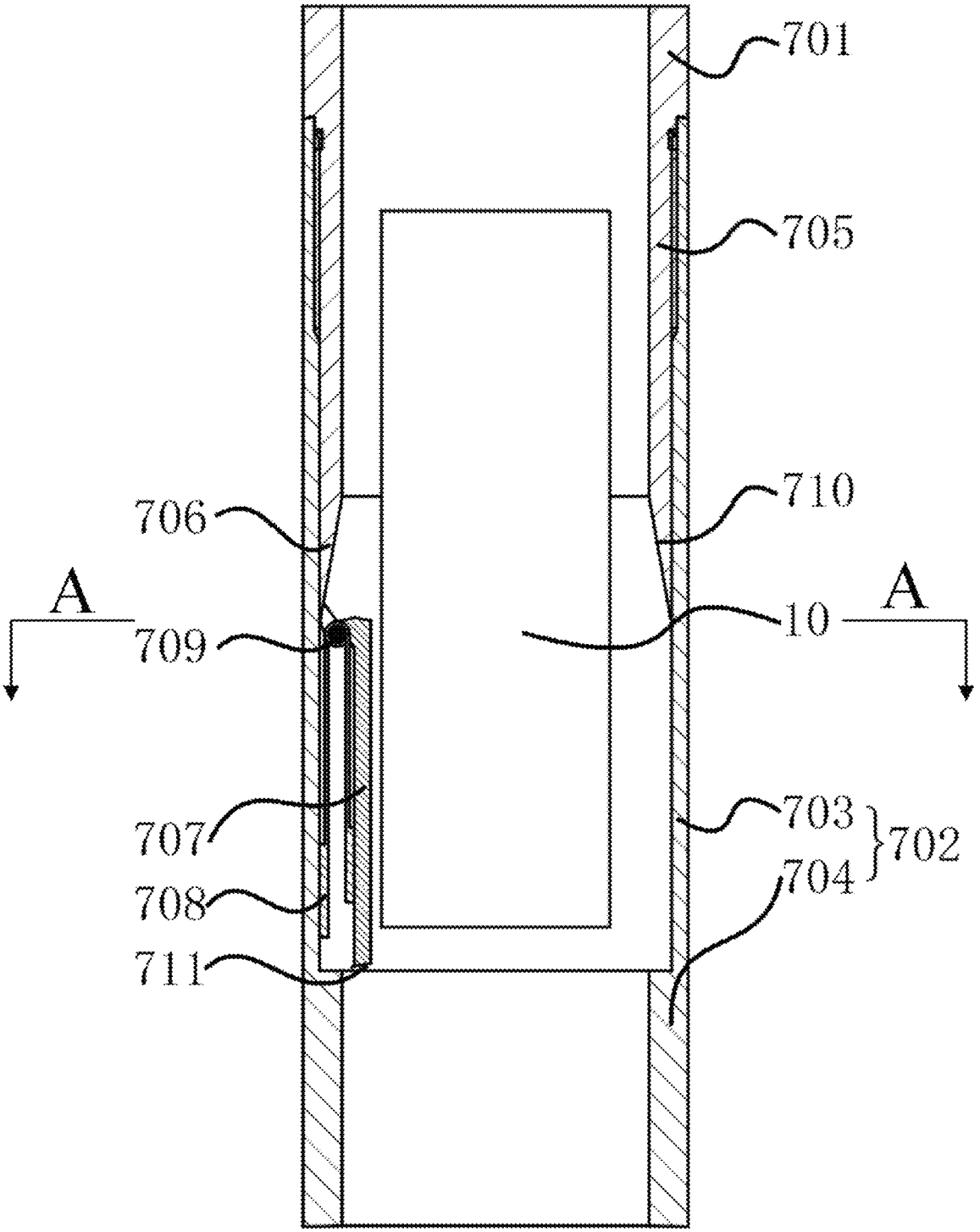
FIG. 1A is a cross-sectional view of the internal blowout-prevention gas-retaining connector along the axial direction when it is opened.
Figure 1B:
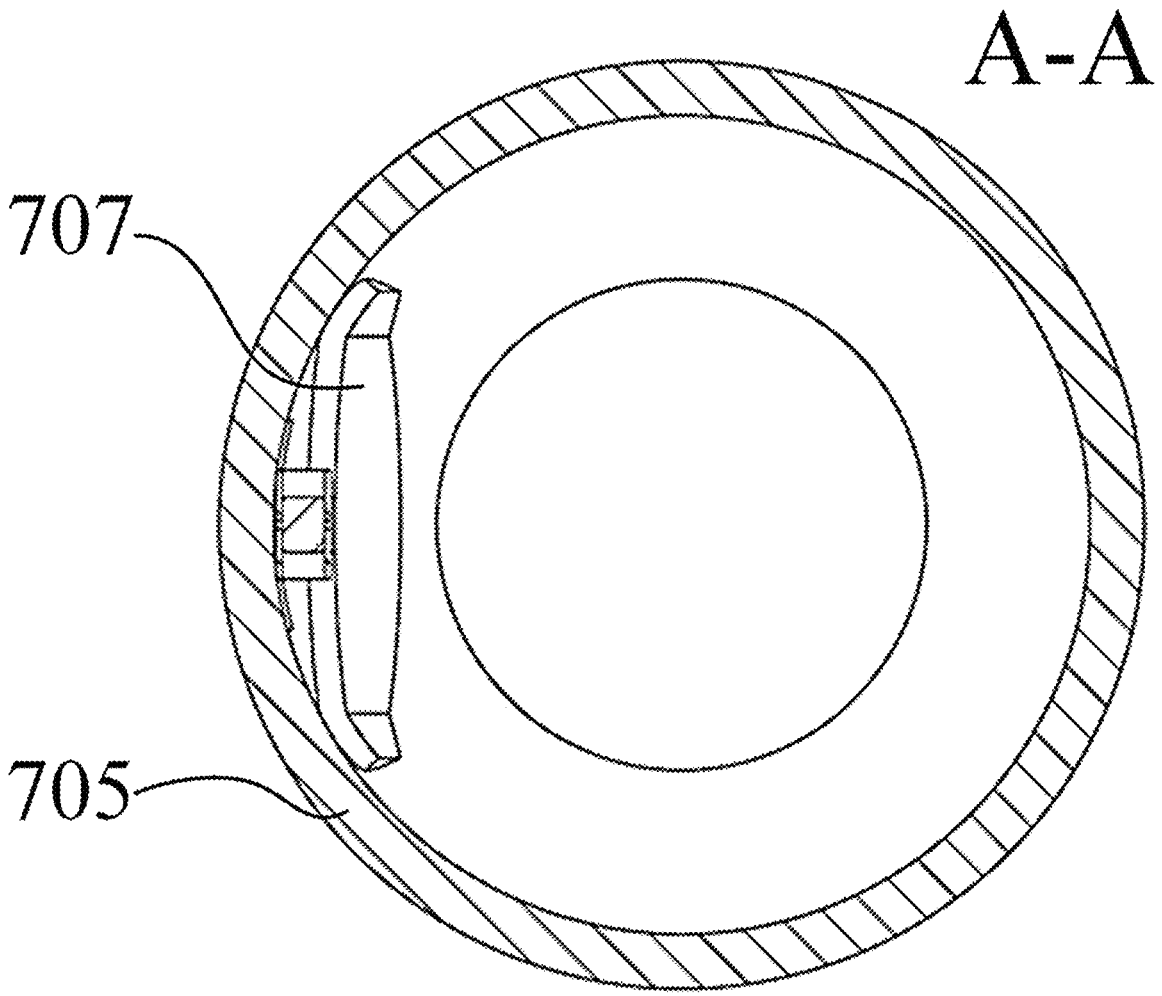
FIG. 1B is a top cross-sectional view of the internal blowout-prevention gas-retaining connector at the A-A direction when it is opened.
Figure 2:
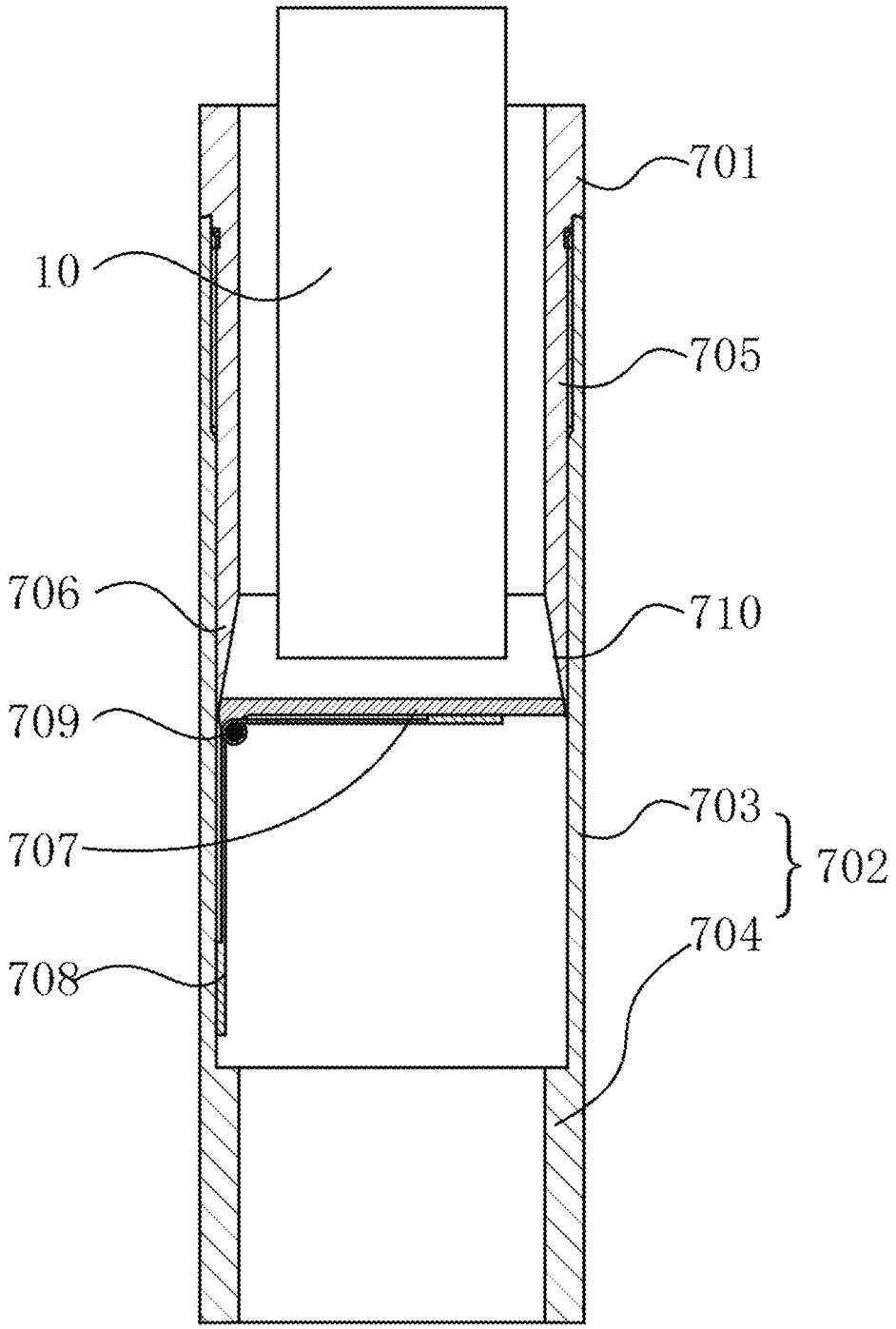
FIG. 2. The cross-sectional view of the internal blowout-prevention gas-retaining connector along the axial direction when it is closed.
Figure 3:
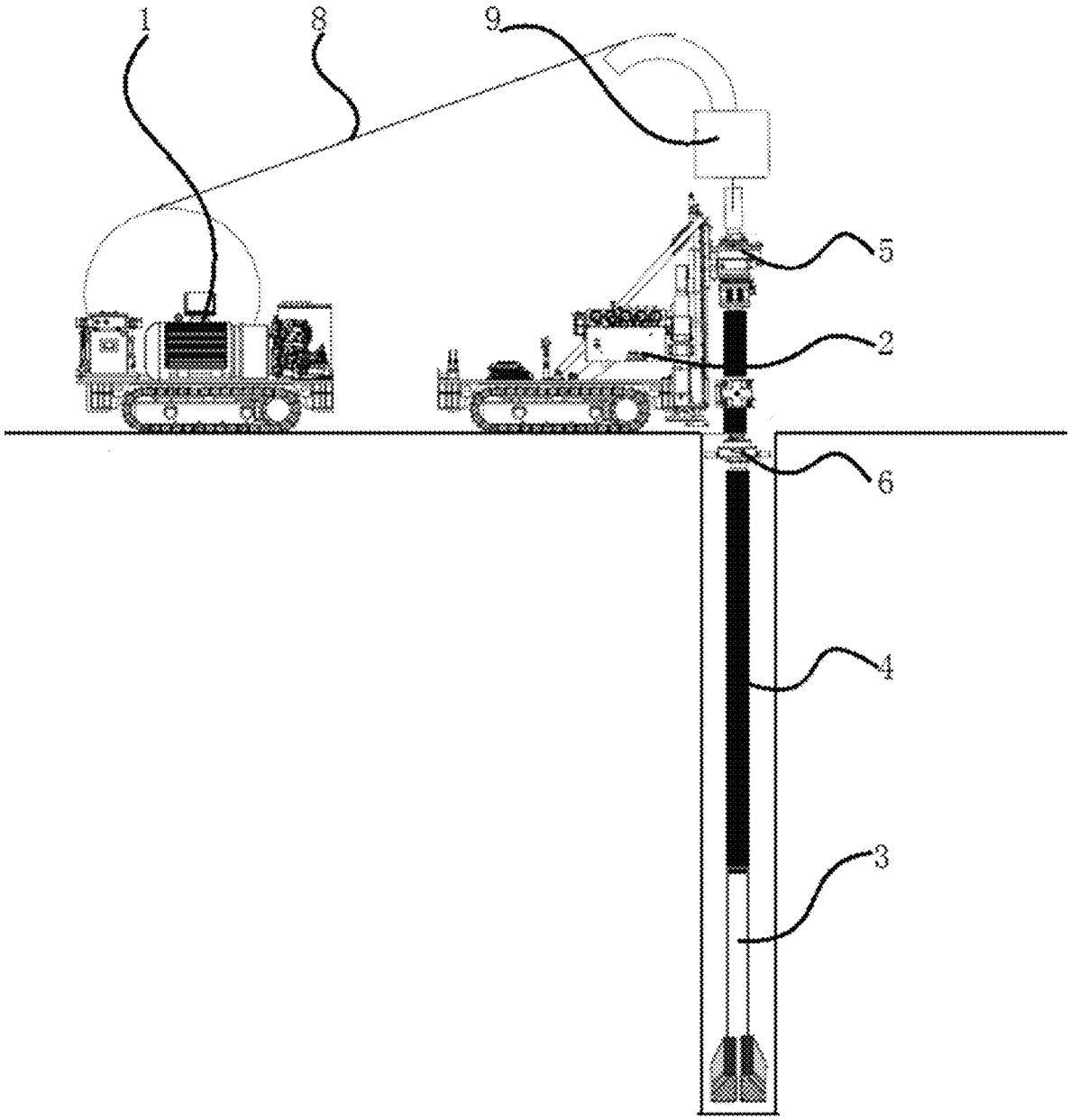
FIG. 3. Schematic diagram of coring operation.

As shown in FIGS. 1A, 1B, 2, and 3, the present invention disclosed an internal blowout-prevention gas-retaining connector used in coring apparatus;

The internal blowout-prevention gas-retaining connector consisted of a valve pipe section 701 and a connecting pipe section 702, and both of them were disassembly connected. The bottom end of the valve pipe section 701 was a male terminal end, while the top end of the connecting pipe section 702 was a female terminal end;

A female terminal section 703 was provided on the top of the connecting pipe section 702, while the outlet section 704 was provided on the bottom of the connecting pipe section 702, and the internal diameter of the female terminal section 703 was greater than that of the outlet section 704, but the internal diameter of the outlet section 704 was greater than the external diameter of the inner pipe assembly;

A male terminal section 705 was provided on the bottom of the valve pipe section 701, a blowout-prevention valve seat 706 was provided at the bottom end of the valve pipe section 701, and a blowout-prevention valve bonnet 707 was provided on the bottom surface of the valve pipe section 701; an edge of the blowout-prevention valve bonnet 707 was rotatably connected to a bottom surface edge of the valve pipe section 701; a torsion spring 708 was provided on a bottom surface of the blowout-prevention valve bonnet 707; one end of the torsion spring 708 was connected to the blowout-prevention valve bonnet 707, and the other end of the torsion spring 708 was connected to the female terminal section 703; the sealing surface of the blowout-prevention valve seat 706 was the first inclined surface 710 whose diameter gradually increased from top to bottom, the sealing surface of the blowout-prevention valve bonnet 707 was the second inclined surface 711, and the first inclined surface 710 was adapted to the second inclined surface 711;

For better fixation of the torsion spring 708 and the blowout-prevention valve bonnet 707, a cylindrical pin 709 was also comprised, which was arranged on the bottom surface of the blowout-prevention valve bonnet 707, and penetrated through the blowout-prevention valve bonnet 707 and the torsion spring 708;

The sum of the length of the male terminal section 705 and the diameter of the blowout-prevention valve bonnet 707≤the length of the female terminal section 703; when the present invention was in the open state, that is, the blowout-prevention valve bonnet 707 was in erect position, the blowout-prevention valve bonnet 707 was still in the female terminal section 703;

the blowout-prevention valve bonnet 707 can be elastically deformed; when the blowout-prevention valve bonnet 707 was crushed open by the inner pipe assembly, the blowout-prevention valve bonnet 707 could become curved (see FIG. 1B), thereby tightening the inner wall of the female terminal section 703, that allowed the device structure to become more tightly compact.

The continuous guide pipe operation equipment included a roller device 1 and a transport device 2; The roller device 1 was used to deliver ropes, continuous pipes, and other puller components 8; The transfer device 2 consisted of an injection head 9, a blowout-prevention box 5, and a drill pipe driving device 6; the drill pipe driving device 6 drove the external pipe assembly of the corer to turn round and press down with the aid of the drill pipe 4; the blowout-prevention box 5 was located at the top of the drill pipe 4 to prevent gas eruptions; the injection head 9 drove the puller component 8 to complete the ascending and descending movement of the inner pipe assembly 10 in corer 3, and then the puller component 8 crossed through the blowout-prevention box 5 and entered the drill pipe 4; during actual work, the drill pipe driving device 6 was used to trap the top circumference of the drill pipe 4, and after the puller component 8 was attached to the inner pipe assembly 10, the inner pipe assembly 10 was placed into the drill pipe 4 and dropped, and then was incorporated into the external pipe assembly;

Before the inner pipe assembly 10 entered the internal blowout-prevention gas-retaining connector, the blowout-prevention valve bonnet 707 was in a horizontal state under the action of torsion spring 708, and the internal blowout-prevention gas-retaining connector was in a closed state;

After the inner pipe assembly 10 entered the internal blowout-prevention gas-retaining connector, the inner pipe assembly 10 crashed the blowout-prevention valve bonnet 707 open, and since the blowout-prevention valve bonnet 707 are prone to deformation, the blowout-prevention valve bonnet 707 closely attached to the inner wall of the internal blowout-prevention gas-retaining connector;

After inner pipe assembly 10 left the internal blowout-prevention gas-retaining connector, the blowout-prevention valve bonnet 707 recovered to the horizontal state under the action of torsion spring 708, and presented in a flat-plate state; the internal blowout-prevention gas-retaining connector was also closed.

There are, of course, a number of other examples of the present invention, and the persons skilled in the art will appreciate that many modifications and variations can be made based on the present invention, without department from the spirit and substance of the present invention, but these corresponding modifications and variations should fall within the protection scope of the claims attached in the present invention.

The invention claimed is:

1. An internal blowout-prevention gas-retaining connector for mine, comprising:

a body comprising a valve pipe section having a first end and a second end and a connecting pipe section having a first end and a second end arranged from top to bottom, a second end of the valve pipe section being inserted into a first end of the connecting pipe section, wherein a blowout-prevention valve seat is provided at the second end of the valve pipe section, and a blowout-prevention valve bonnet is rotatably connected to a bottom surface edge of the valve pipe section, a torsion spring is provided on a bottom surface of the blowout-prevention valve bonnet, and a first end of the torsion spring is connected to the bottom surface of the blowout-prevention valve bonnet, and a second end of the torsion spring is connected to an inner wall of the connecting pipe section, wherein the blowout-prevention valve bonnet is elastically deformable, and wherein: when the blowout-prevention valve bonnet is in an open state, the blowout-prevention valve bonnet is curved and is adapted to the inner wall of the female terminal section; and when the blowout-prevention valve bonnet is in a closed state, the blowout prevention valve bonnet is in a horizontal position relative to the female terminal section and is in a shape of a flat plate.

2. The connector according to claim 1, wherein a male terminal section is provided at the second end of the valve pipe section, a female terminal section is provided at the first end of the connecting pipe section, an outlet section in provided at the second end of the connecting pipe, and an inner diameter of the female terminal section is greater than an inner diameter of the outlet section.

3. The connector according to claim 2, wherein a sum of a length of the male terminal section and a diameter of the blowout-prevention valve bonnet is less than or equal to a length of the female terminal section.

4. The connector according to claim 2, wherein the valve pipe section and the connecting pipe section are threadedly connected.

5. The connector according to claim 1, wherein the connector further comprises a cylindrical pin, wherein the cylindrical pin is arranged on the bottom surface of the blowout-prevention valve bonnet, and extends through the blowout-prevention valve bonnet and the torsion spring.

6. The connector according to claim 1, wherein a sealing surface of the blowout-prevention valve seat is a first inclined surface whose diameter gradually increases from top to bottom, a corresponding sealing surface of the blowout-prevention valve bonnet is a second inclined surface, and the first inclined surface is configured to engage the second inclined surface and form a sealing.

* * * * *